US005242611A

United States Patent [19]

Griffaw

[11] Patent Number: 5,242,611

[45] Date of Patent: Sep. 7, 1993

[54] ELECTRICAL CONTACT PROTECTIVE LUBRICANT

[76] Inventor: Norman E. Griffaw, 1204 Sixth St., Port Hueneme, Calif. 93041

[21] Appl. No.: 977,038

[22] Filed: Nov. 16, 1992

Related U.S. Application Data

[63] Continuation-in-part of Ser. No. 640,846, Jan. 14, 1991, abandoned.

[51] Int. Cl.[5] ..... C10M 141/12

[52] U.S. Cl. ..... 252/41; 252/389.23; 106/14.41; 106/14.42; 106/14.27

[58] Field of Search ..... 252/41, 389.23; 106/14.41, 14.42, 14.27

[56] References Cited

U.S. PATENT DOCUMENTS 4,192,768 3/1980 Budnick ..... 252/389

4,578,215 3/1986 Bradley ..... 252/514

*Primary Examiner*—Jerry D. Johnson

*Attorney, Agent, or Firm*—Jack C. Munro

[57] ABSTRACT

An electrical contact protective lubricant composed of a homogenously mixed mixture of transmission fluid, lithium based grease and petroleum jelly.

1 Claim, No Drawings

ELECTRICAL CONTACT PROTECTIVE LUBRICANT

REFERENCE TO PRIOR APPLICATION

This application is a continuation-in-part of U.S. patent application Ser. No. 07/640,846, filed Jan. 14, 1991, now abandoned by the same title and by the first named inventor Norman E. Griffaw.

BACKGROUND OF THE INVENTION

The field of this invention relates to lubricants and more particularly to a corrosion protective lubricant designed primarily to be utilized on electrical contacts.

Corrosion is defined as the insidious destruction of metals by chemical reaction (mainly oxidation) within the environment. Corrosion is primarily an electrochemical process. Small cells are set up in the corroding metal with the potential difference being due to the different metals present or to different concentrations of oxygen or electrolyte. Corrosion takes place at the anode. In electrical contacts, corrosion occurs due to the intermittent conducting of electricity through the contacts.

Electrical circuits cannot corrode when there is a constant flow of electricity going through it. So, since most equipment is deactivated every now and then, the flow of electricity stops. It is during the "off" time that corrosion develops. Corrosion is like a disease, it spreads and gets worse and worse. It can be controlled and eliminated from your electrical system.

There are various ways to prevent corrosion in electrical contacts. One way is to construct the contacts of electrically conductive material which resists corrosion. However, at the present time, all materials used in making electrical contacts will corrode over a period of months and years. Another way is to protect the contacts from atmospheric conditions. This could be accomplished by enclosing the contacts in a vacuum which in almost all instances is impractical. Another way is to apply a protective metal coating which is known as galvanizing. However, galvanizing decreases or in some cases substantially eliminates conductivity between the contacts. Therefore, galvanizing is also impractical. Another way would be to apply a thin film of oil. However, oil on electrical contacts is at best a temporary corrosion preventer. Instead of using oil, it has been common to substitute a grease with the grease assuming a solid consistency where the oil is a liquid. Grease is known to protect electrical contacts for some period of time and this period of time can be as long as several months.

Corrosion of electrical contacts produces an electrical insulator. This electrical insulator would diminish and eventually completely prevent the conducting of electricity across the contacts. The most common way, at the present time, to prevent the effective corrosion on electrical contacts is to physically remove the produced electrical insulation on the contacts. It is common to manually remove, as by sanding, this insulation. This means that regular periodic maintenance is required of all electrical contacts within a piece of machinery. In certain environments, such as for example on-board a ship where the atmosphere is of continuous high humidity, this maintenance can require a substantial number of man hours over a period of a year. On a typical ship there are thousands of electrical contacts that need to be maintained on a regular basis.

In the past, grease on electrical contacts is known to physically deteriorate after a period of time. Generally this period of time is within months or at best a year or two. Prior to the present invention there has not been utilized any kind of a grease which was an effective protectant for electrical contacts for many years.

In automobiles and trucks, it is common to change parts with the problem not being solved. Only after hundreds of dollars have been spent on parts that were not needed, "faulty wiring" will be determined to be the culprit. Electrical systems need more attention than what they are getting.

SUMMARY OF THE INVENTION

The primary objective of the present invention is to construct a grease to be placed on and about electrical contacts which permits the contacts to operate normally and provides an environmental barrier between the contacts and the ambient which prevents the contacts from deteriorating due to temperature and moisture.

Another objective of the present invention is to produce a composition which remains moist and pliable over a period of years thereby providing an effective protectant for electrical contacts from ambient conditions. When moisture is allowed to enter the wiring system, it develops into corrosion. The composition of this invention allows voltage to complete its path without any obstructions. The composition of this invention also works as an excellent conductor of electricity.

Another objective of the present invention is to construct an electrical contact protective lubricant which can be manufactured at a relatively inexpensive price and therefore sold to the ultimate consumer at an inexpensive price.

Another objective of the present invention is to substantially eliminate electrical shorts in equipment which opens the electrical equipment to being protected by warranty which is unheard of at the present time.

The anti-corrosion lubricant of the present invention is composed of petroleum jelly in the amount of 52.1 to 52.4 percent by weight, lithium based grease in the amount of 47.2 percent to 47.64 percent by weight and transmission fluid in the amount of 0.004 percent to 0.7 percent by weight. The composition of all three ingredients or constituents is evenly mixed.

DETAILED DESCRIPTION OF THE INVENTION

The electrical contact protective lubricant of this invention is to be composed of the following ingredients in the following amounts:

| Measurements in grams and ounces) | |
|---|---|
| MIXTURE A | 20 gm. (.7 oz.) of Transmission Fluid |
| | 47.2 ozs. of Lithium Based Grease |
| | 52.1 ozs. of Petroleum Jelly |
| MIXTURE B | 15 gm. (.5 oz.) of Transmission Fluid |
| | 47.3 ozs. of Lithium Based Grease |
| | 52.2 ozs. of Petroleum Jelly |
| MIXTURE C | 12.5 gm. (.4 oz.) of Transmission Fluid |
| | 47.3 ozs. of Lithium Based Grease |
| | 52.3 ozs. of Petroleum Jelly |
| MIXTURE D | 10 gm. (.3 oz.) of Transmission Fluid |
| | 47.4 ozs. of Lithium Based Grease |
| | 52.3 ozs. of Petroleum Jelly |
| MIXTURE E | 7.5 gm. (.2 oz.) of Transmission Fluid |

-continued

| Measurements in grams and ounces) | |
|---|---|
| | 47.4 ozs. of Lithium Based Grease |
| | 52.4 ozs. of Petroleum Jelly |
| MIXTURE F | 2.5 gm. (.09 oz.) of Transmission Fluid |
| | 47.6 ozs. of Lithium Based Grease |
| | 52.31 ozs. of Petroleum Jelly |
| MIXTURE G | 2.0 gm. (.07 oz.) of Transmission Fluid |
| | 47.63 ozs. of Lithium Based Grease |
| | 52.3 ozs. of Petroleum Jelly |
| MIXTURE H | 1.5 gm. (.05 oz.) of Transmission Fluid |
| | 47.63 ozs. of Lithium Based Grease |
| | 52.32 ozs. of Petroleum Jelly |
| MIXTURE I | 1.0 gm. (.04 oz.) of Transmission Fluid |
| | 47.63 ozs. of Lithium Based Grease |
| | 52.33 ozs. of Petroleum Jelly |
| MIXTURE J | .5 gm. (.02 ozs.) of Transmission Fluid |
| | 47.64 ozs. of Lithium Based Grease |
| | 52.34 ozs. of Petroleum Jelly |
| MIXTURE K | .1 gm. (.004 oz.) of Transmission Fluid |
| | 47.694 ozs. of Lithium Based Grease |
| | 52.302 ozs. of Petroleum Jelly |

Each of the above mixtures are for producing one hundred ounces (100 ozs.) of the lubricant. Mixes A through K are all solids. However, Mixture A is the thinnest mixture, approaching a liquid, while Mixture K is the most viscous resembling a ninety weight grease. Preferable mixtures are Mixture E through G. All the above mixtures can be used as an effective protective lubricant against ambient moisture and heat as well as temperature generated by the piece of equipment which includes the electrical contacts to which the protective lubricant of the present invention has been applied. The protective lubricant of the present invention will retain a soft pliable nature for an extended period of years thereby functioning as a satisfactory protective lubricant for that period of time.

It is desirable to use a viscous form of lubricant within the lubricant of the present invention. A desirable viscous form of lubricant would be a grease. Greases are generally mineral oils thickened with a metallic soap (a metal salt of an organic acid) or clay. Additives can be used as with oils. Calcium, lime or sodium greases are capable of being somewhat satisfactory within this invention. However, the most satisfactory form of grease is a lithium based grease. Basically, a lithium based grease constitutes mineral oil with a lithium thickener.

The lithium based grease is readily available from numerous sources. One source is STA-LUBE, INC. of Rancho Dominguez, Calif. The product numbers for STA-LUBE, INC. of the lithium based grease are 3150 to 3159, 3344 and 3360.

Petroleum jelly is an exceedingly common product, again manufactured by numerous manufacturers. One particular manufacturer is BI-JON LABORATORIES, INC. of St. Louis, Mo., Product No. PN-142.

The transmission fluid causes the lubricant of this invention to adhere to the electrical contacts and prevent drying out of the lubricant even years after the application. The lubricant will remain in a soft, pliable form for years. Because the lubricant remains soft and pliable, it remains continually protective.

Transmission fluids are well-known and in common use with a typical usage for transmission fluid to be contained within a vehicular transmission which is used in the power train of a vehicle. Generally, transmission fluids are of a petrolium base. Within the present invention, it has been found that a transmission fluid sold under the tradename of DEXTRON II MERCON manufactured by Valvoline, a subsidiary of Ashland Oil Co., Inc. of Lexington, Ky., has been satisfactory.

A desirable composition for the transmission fluid would be by volume: 94.198 percent of a base oil such as mineral oil; 1.0 percent of a viscosity index improver such as polymethacrylate; 0.3 percent of a corrosion inhibitor such as phosphosulfurized terpene; 0.3 percent of an oxidation inhibitor such as phenyl alpha naphthylamine; 0.4 percent of a friction modifier such as 6.6'-dithio-bis (3,5-carbolactone-1-heneicosanoic acid); 2.0 percent of a seal swellant such as dihexyl phthalate; 1.5 percent of a dispersant such as amidated polyisobutylene succinate; 0.3 percent of an antiwear agent such as zinc dialkyl dithio phosphate; and 0.002 percent of an antifoamant such as polydimethyl siloxane.

The viscosity index improver functions to counteract the tendency of oils to become thinner as temperature increases. The function of the oxidation inhibitor prevents the formation of sludge by reaction of the oil with atmospheric oxygen. The antiwear gent neutralizes the corrosive acid gases the electrical contacts may be exposed to such as within the environment of the exhaust of an internal combustion engine. The dispersant prevents the build-up to particles, such as carbon, on the lubricated surface. The corrosion inhibitor obviously is for the purpose of preventing corrosion on the electrical contacts. The friction modifier is important in that it helps the lubricant to adhere to the electrical contacts preventing ambient air from coming into direct connection with the electrical contacts. This adherence of the lubricant when using a desirable friction modifier will be for a period of years. The purpose of the antifoamant is to prevent the lubricant from absorbing gases over the extended period of time of use. The seal swellant works in conjunction with the friction modifier. The purpose of the seal swellant, besides adding to the benefit of the friction modifier is that it provokes swelling of the lubricant.

It is considered to be within the scope of this invention that other transmission fluids could be utilized.

Recently, tests have been conducted by an independent testing laboratory which compared the lubricant of this invention to two well known prior art lubricants which are utilized for the same purpose. The tests were completed by testing (1) under vacuum at room temperature and (2) under high temperature at no vacuum. The results of test (1) of both a thin portion and a thick layer of the lubricant of this invention did not show any sign of evaporation even after four full days. Both the two prior art lubricants experienced almost complete evaporation, hence totally ineffective. Under test (2), the lubricant of this invention was found to withstand 330 degrees Fahrenheit for four hours with no apparent change occurring. This temperature of 330 degrees Fahrenheit is way above normal conditions of use. The two prior art lubricants completely evaporated at this temperature of 330 degrees Fahrenheit.

This independent testing facility stated that the amazing part of the lubricant of this invention is its ability to not deteriorate with age and resist corrosion as do all other similar lubricants. All other similar lubricants do deteriorate with age and corrode.

What is claimed is:

1. An electrical contact protective lubricant wherein the amount of each constituent when compared to the total volume of said lubricant is within the following ranges:

transmission fluid—0.004 percent to 0.7 percent by weight;

lithium based grease—47.2 percent to 47.64 percent by weight;

petroleum jelly—52.1 percent to 52.4 percent by weight; and said transmission fluid includes the following ingredients: mineral oil; polymethacrylate; phosphosulfurized terpene; phenyl alpha naphthylamine; 6,6'-dithio-bis (3,5-carbolactone-1-heneicosanoic acid); dihexyl phthalate; polyisobutylene succinate; zinc dialkyl dithio phosphate and polydimethyl siloxane.

* * * * *